US007691431B2

(12) United States Patent
Feng et al.

(10) Patent No.: US 7,691,431 B2
(45) Date of Patent: Apr. 6, 2010

(54) SYSTEM AND METHOD FOR SPRAY COATING MULTIPLE MEDICAL DEVICES USING A ROTARY ATOMIZER

(75) Inventors: James Feng, Brooklyn Park, MN (US); Narin Anderson, Eden Prairie, MN (US); Tom Eidenschink, Rogers, MN (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 1017 days.

(21) Appl. No.: 11/368,538

(22) Filed: Mar. 7, 2006

(65) Prior Publication Data

US 2007/0212477 A1 Sep. 13, 2007

(51) Int. Cl.

| | |
|---|---|
| ***B05C 11/08*** | (2006.01) |
| ***B05D 1/02*** | (2006.01) |
| ***B05D 1/40*** | (2006.01) |
| ***B05D 7/14*** | (2006.01) |
| ***B05B 13/02*** | (2006.01) |

(52) U.S. Cl. ..... 427/2.24; 427/2.1; 427/2.25; 427/421.1; 427/425; 427/427.1; 118/52; 118/53; 118/319; 118/320

(58) Field of Classification Search ..... 427/2.1–2.31, 427/421.1; 118/500, 300, 305, 323
See application file for complete search history.

(56) References Cited

U.S. PATENT DOCUMENTS

| | | | | |
|---|---|---|---|---|
| 3,144,350 | A | 8/1964 | Osame | |
| 4,148,932 | A | 4/1979 | Tada et al. | |
| 4,458,844 | A | 7/1984 | Mitsui | |
| 4,887,770 | A | 12/1989 | Wacker et al. | |
| 5,032,052 | A | 7/1991 | Swain | |
| 5,078,321 | A | 1/1992 | Davis et al. | |
| 6,056,215 | A * | 5/2000 | Hansinger et al. | 239/703 |
| 6,649,116 | B2 * | 11/2003 | Stephenson et al. | 264/439 |
| 6,709,514 | B1 * | 3/2004 | Hossainy | 118/52 |

(Continued)

FOREIGN PATENT DOCUMENTS

| | | |
|---|---|---|
| EP | 0046175 | 2/1982 |
| GB | 1298063 | 11/1972 |

OTHER PUBLICATIONS

Product Information. Fung Yu Group. reteived form www.fungyu.com Jan. 1996.*

(Continued)

*Primary Examiner*—Timothy H Meeks
*Assistant Examiner*—Cachet I Sellman
(74) *Attorney, Agent, or Firm*—Kenyon & Kenyon LLP

(57) ABSTRACT

A system is provided for spray coating medical devices, comprising a rotary atomizer with one or more rotary heads and a plurality of holders to hold a plurality of medical devices, such as stents, wherein the holders are positioned around a longitudinal axis of the rotary head. A method of using such a system is also provided. The invention enables the use of rotary atomizers to coat small medical devices with reduced waste of coating material and allows increased production throughput by the coating of multiple devices simultaneously. The rotary atomizer may be an electrostatic rotary atomizer. The holders and/or a holding structure on which the holders are mounted may move relative to the rotary atomizer.

11 Claims, 7 Drawing Sheets

U.S. PATENT DOCUMENTS

| | | | | |
|---|---|---|---|---|
| 6,982,004 | B1 * | 1/2006 | Malik et al. | 118/634 |
| 2004/0013792 | A1 | 1/2004 | Epstein et al. | |
| 2004/0148015 | A1 * | 7/2004 | Lye et al. | 623/1.15 |
| 2005/0273161 | A1 | 12/2005 | Malik et al. | |

OTHER PUBLICATIONS

International Preliminary Report on Patentability with Written Opinion of the International Searching Authority (PCT/US2007/005675), dated Sep. 9, 2008.

* cited by examiner

SYSTEM AND METHOD FOR SPRAY COATING MULTIPLE MEDICAL DEVICES USING A ROTARY ATOMIZER

TECHNICAL FIELD

The present invention relates to the spray coating of medical devices.

BACKGROUND

Many implantable medical devices have been coated with various types of coatings, such as coatings for delivering a therapeutic agent or drug to a site within the body, coatings for radiopacity, or coatings for biocompatibility. One example of a drug-coated implantable medical device is a stent, which is a tubular structure formed in a mesh-like pattern that is designed to be inserted into an organ or vessel and serve as a scaffolding. For example, a stent may be placed in a coronary artery across an area of blockage that has been opened by an angioplasty procedure. In many instances, however, the stented area becomes blocked again (known as restenosis) due to various biological processes, including tissue healing and regeneration, scar formation, irritation, and immune reactions that lead to an excess proliferation of the cells. Therefore, many stents are coated with a drug, such as paclitaxel or other therapeutic agent, that acts to inhibit the processes that cause restenosis.

Various methods have been proposed or employed for coating stents and other medical devices. Such methods include spray coating, dip coating, etc. These methods have various advantages and disadvantages. For example, some spray coating methods result in a large amount of coating being wasted. Spray deposition efficiencies are important as coating materials (e.g., a drug and polymer matrix) have become more expensive. As another example, some coating methods are slow and result in lengthy and costly production. As another example, some coating methods result in non-uniform coatings or fail to apply sufficient coating to certain surfaces. It is often desirable to apply the coating in a uniform manner to ensure that an intact, robust coating of the desired thickness is formed. Some of these drawbacks are trade-offs in certain coating processes. For example, in order to achieve the desired uniformity and completeness of the coating in a spray coating process, stents are commonly spray coated individually, with each stent separately loaded onto a stent holder and then separately spray coated. This individual handling can slow the production rate.

The present invention is directed to an improvement to overcome certain drawbacks in prior coating systems.

SUMMARY OF THE INVENTION

The present invention involves the use of a rotary atomizer to coat medical devices such as stents. A rotary atomizer has a rapidly rotating cup with a flow surface onto which coating material is delivered. Under centrifugal force, the coating material flows outwardly on the flow surface in a thin film and is then flung radially outward from the peripheral edge of the rotary atomizer cup in the form of ligaments or thin sheets. These ligaments or thin sheets then break into droplets due to capillary instability. In conventional rotary atomizer coating systems, an air stream is used to direct the droplets toward the object to be coated, which is placed in front of the rotating cup. FIGS. 1A and 1B show such a rotary atomizer coating system. The droplets directed by the air stream form a spray plume of atomized coating material.

A conventional rotary atomizer generates a spray plume that is wider than the size of small medical devices such as stents. Using a conventional rotary atomizer system as in FIGS. 1A and 1B to spray coat a stent or other small medical device would result in much of the coating material being lost in overspraying. Reducing the size of the rotating cup would require increasing the rotation speed of the smaller cup to achieve the desired atomization, but this presents complications and challenges in machinery design.

The present invention enables the use of a rotary atomizer to coat small medical devices such as stents by positioning a plurality of the medical devices around the longitudinal axis of the rotary head. In one embodiment of the invention, the system includes a rotary atomizer and a holding structure for holding an array of medical devices in a circle around the rotary atomizer in position to be simultaneously coated by the rotary atomizer. The rotary atomizer may have a cup or disk-type rotary head. The rotary atomizer may have the ability to electrostatically charge the coating material.

In an exemplary embodiment, the holding structure is a carousel that holds the stents in a circumferential array around the rotary atomizer. The carousel carries a mechanism that spins each of the stents individually around its longitudinal axis. The carousel itself may also rotate so that the array of stents orbits or revolves around the rotary atomizer. The carousel and the rotary atomizer may move relative to each other in a longitudinal direction.

The present invention is also directed to a method of using such a system of spray coating medical devices.

DETAILED DESCRIPTION

Figure 1A:
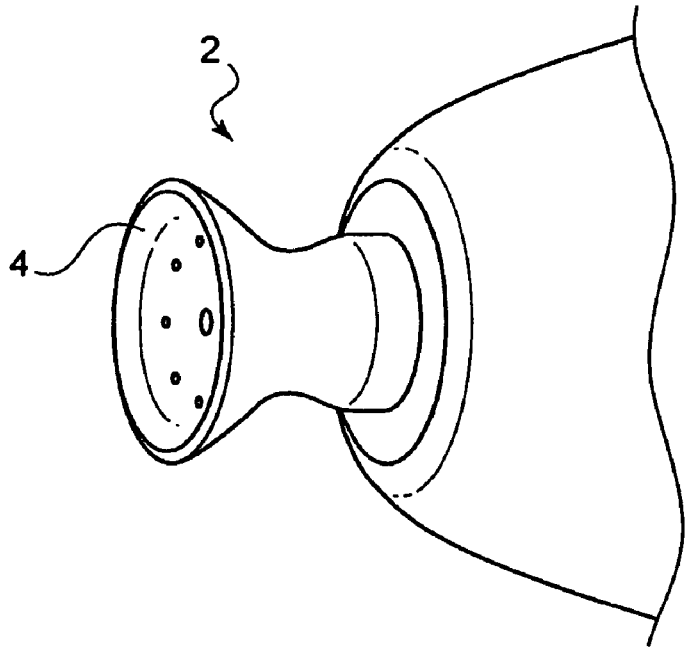
FIG. 1A (PRIOR ART)
FIG. 1A shows a prior art rotary atomizer.
Figure 1B:
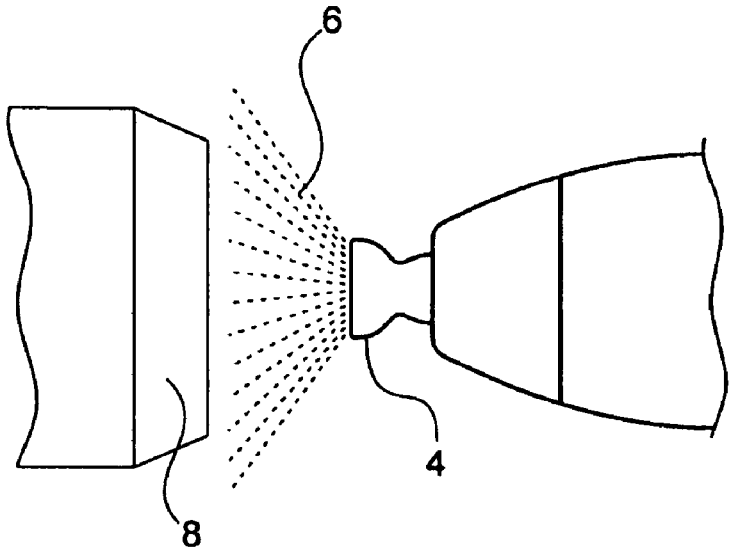
FIG. 1B (PRIOR ART)
FIG. 1B shows the prior art rotary atomizer of FIG. 1A being used to spray coat an object.

FIGS. 1A and 1B show a prior art rotary atomizer 2. The rotary atomizer has a cup 4 with a flow surface onto which coating material is delivered. When the cup is spun, the coating material on the flow surface is flung radially outward and break into droplets. As shown in FIG. 1B, an air stream directs the droplets into a directed spray plume 6 toward an object 8 placed in front of the rotating cup 4.

Using a system as shown in FIG. 1B to spray coat a stent or other small medical device would result in much of the coating material being lost in overspraying. It is possible that the system of FIG. 1B can be made suitable for spray coating small parts by reducing the size of the rotating cup; however, this would require increasing the rotation speed of the cup to achieve the desired atomization, resulting in complications in machinery design. Accordingly, the present invention provides a novel approach for coating small medical devices using a rotary atomizer.

Figure 2:
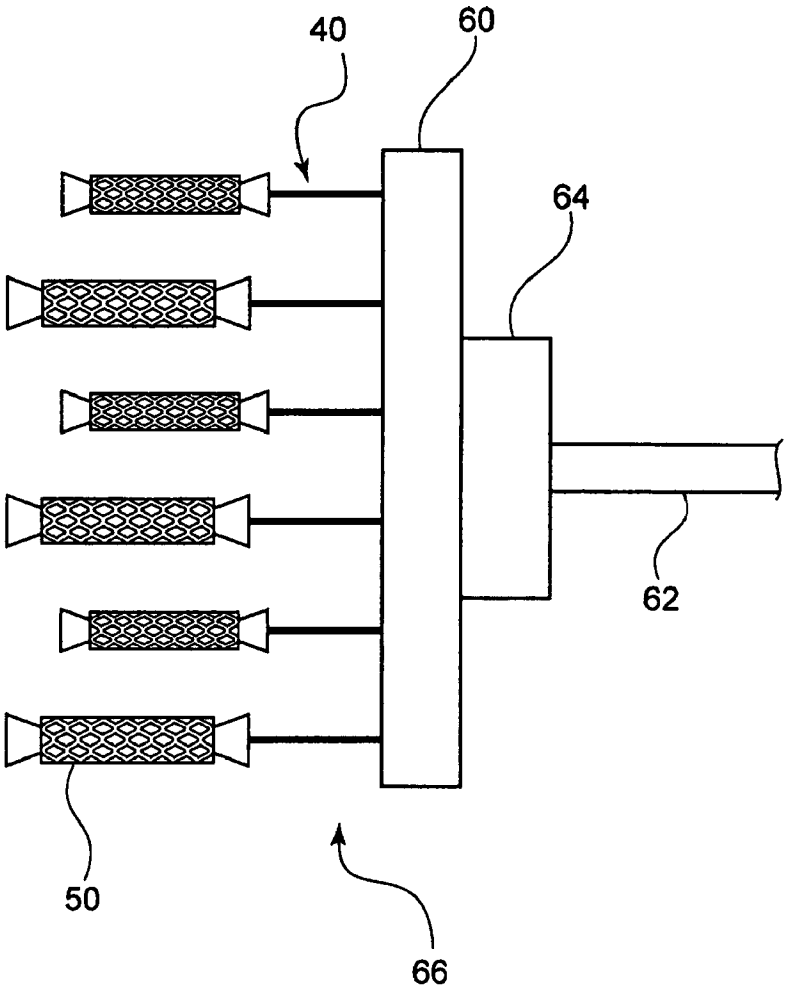
FIG. 2 is a side view of a medical device spray coating system in accordance with an embodiment of the present invention.
Figure 2:
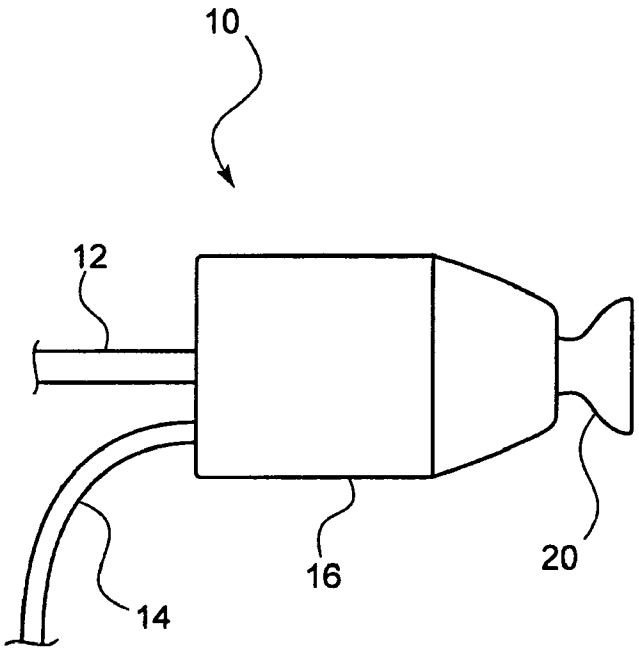
Figure 3:
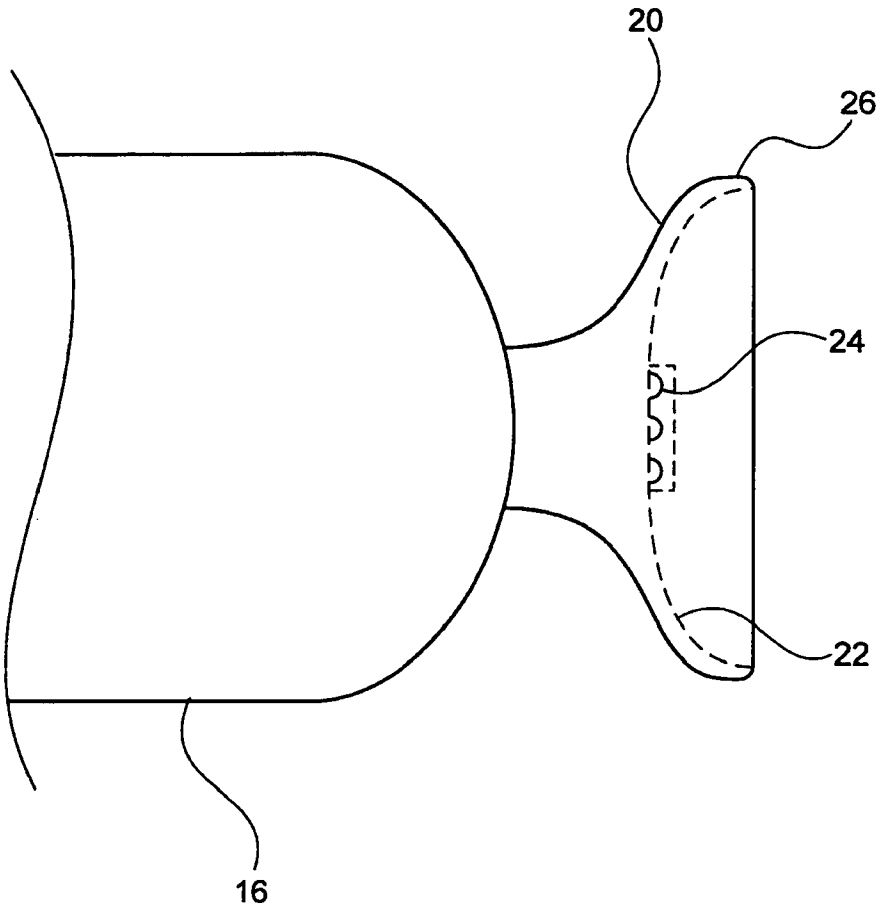
FIG. 3 is an enlarged side view of a cup-type rotary atomizer head in accordance with an embodiment of the present invention.

FIGS. 2 and 3 show an embodiment of the present invention with a rotary atomizer 10 connected to a motor (not shown) by a rotary drive shaft 12 and supplied with coating material through a supply line 14. The rotary head may be in the form of a rotary cup 20 which may have a frustro-conical shape or bowl shape with an interior flow surface 22. Coating material is delivered onto the interior flow surface 22 through outlet orifices 24 near the center of the cup 20. Under centrifugal force, the coating material flows in an outward direction along the interior flow surface 22 of the cup 20. The peripheral edge 26 of the cup 20 is generally convexly arcuate, directing the flow of coating material in a more axial direction to create a cone-shaped spray plume. In an alternate embodiment of the rotary atomizer, as described in U.S. Pat. No. 6,056,215 to Hansinger et al. (filed Apr. 16, 1997), pressurized air is discharged from ports adjacent the rotary cup 20 to assist in shaping and propelling the spray plume. The entire disclosure of U.S. Pat. No. 6,056,215 is incorporated by reference herein.

Figure 4:
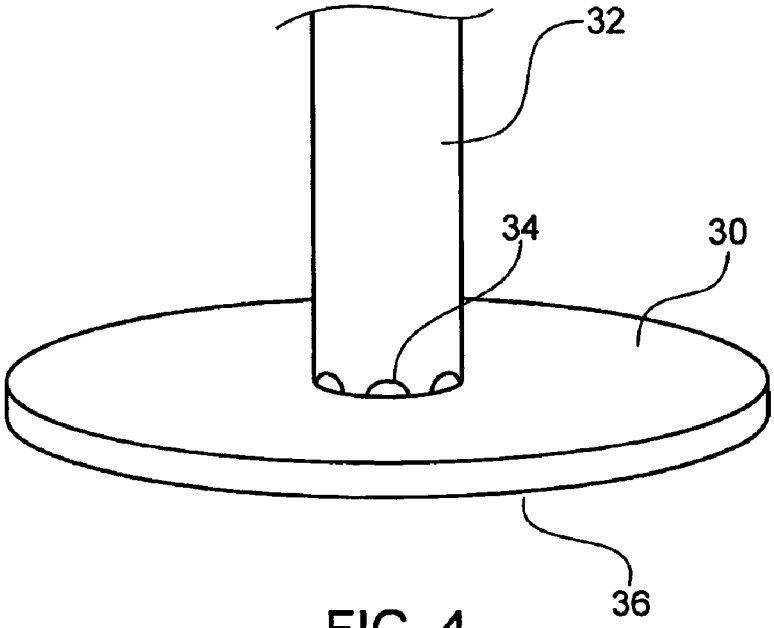
FIG. 4 is an enlarged side view of a disk-type rotary atomizer head in accordance with another embodiment.

Referring to FIG. 4, the rotating head of the rotary atomizer can also be disk-shaped in which the flow surface 30 is substantially flat (i.e., without having a convexly arcuate lip) to direct the flow radially. The coating material is delivered onto the flow surface 30 of the disk 36 through outlet orifices 34 at the distal tip of a connecting shaft 32. Under centrifugal force, the coating material flows outward along the flow surface 30 in a thin film and is then expelled radially from the outer edge of the disk into a sheet-like spray plume of atomized droplets. In certain embodiments of the present invention, a sheet-like spray plume generated by a rotary disk atomizer may be preferred. In other embodiments, a cone-shaped spray plume generated by a rotary cup atomizer may be preferred.

The cup or disk may also have a number of grooves, fins, or ribs on the flow surface as described and illustrated in the Hansinger '215 patent referenced above or in U.S. Pat. No. 4,148,932 to Tada et al. (filed Jan. 25, 1978), the entire disclosure of which is incorporated by reference herein. These grooves, fins, or ribs extend substantially in the same direction as the advancing direction of flow and lead the coating material into branching streams separated from one another, which may improve atomization of the coating fluid.

Figure 5:
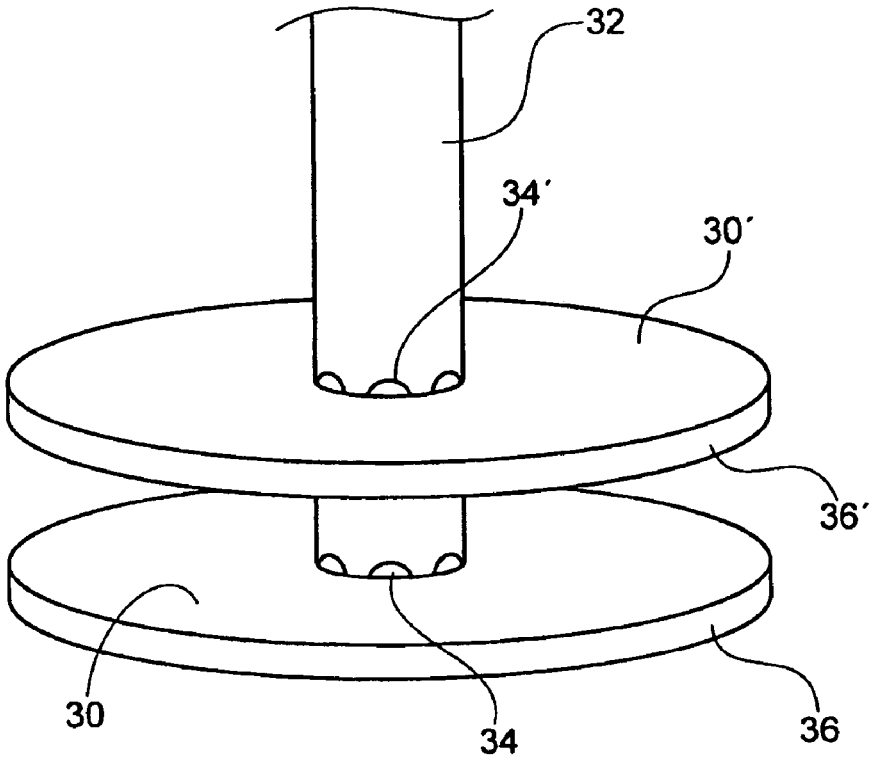
FIG. 5 is an enlarged side view of a disk-type rotary atomizer head having two disks in accordance with yet another embodiment.

In an alternate embodiment, the rotary atomizer may have multiple cups or disks. FIG. 5 illustrates a rotary atomizer having two disks, 36 and 36'. Each disk has a separate flow surface, 30 and 30', and coating material outlet orifices, 34 and 34'. Thus, each disk can be supplied with its own source of coating material so that different coating materials can be applied simultaneously or sequentially. For example, in a single pass, the first disk 36 can apply a base coating of polymer only, followed by the second disk 36' applying a coating of polymer and drug. Alternatively, the first disk 36 can apply, in a single pass, coating of a first polymer and a first therapeutic agent, followed by the second disk 36' applying a second polymer and a second therapeutic agent. One of skill in the art will be able to appreciate that additional coating permutations can be realized by using a rotary atomizer with a plurality of cups or disks.

Referring back to FIG. 2, the rotary atomizer 10 can be an electrostatic rotary atomizer that is well known in the art. Such electrostatic rotary atomizers are adapted to impart an electrical charge to the coating material before it is discharged. Coating efficiency is improved because the resulting electrically charged coating droplets are attracted to the oppositely charged or electrically grounded stents 50 and are deposited on the surface of the stents 50. In the illustrated embodiment, the rotary atomizer 10 is supplied with electric current from an external voltage source (not shown) via a cable connected to one or more charging electrodes that come into electrical contact with the coating material. One of skill in the art will appreciate that there are numerous electrical arrangements for an electrostatic rotary atomizer. For example, the voltage source may be supplied from an internal source, or the rotary head 20 itself may be the electrode.

Figure 6:
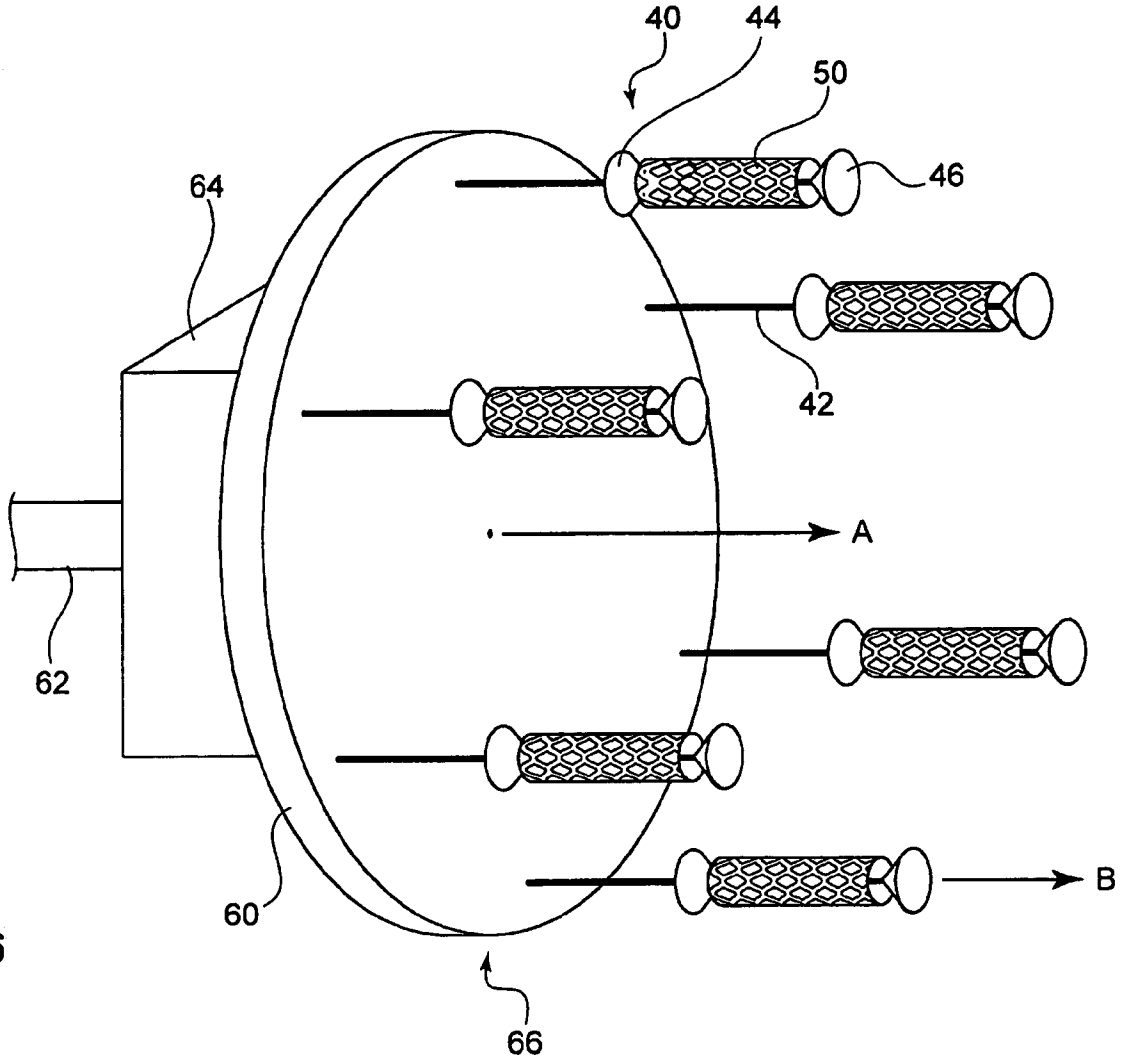
FIG. 6 is a perspective view of the carousel shown in FIG. 2 with stents loaded onto the holder arms.
Figure 7:
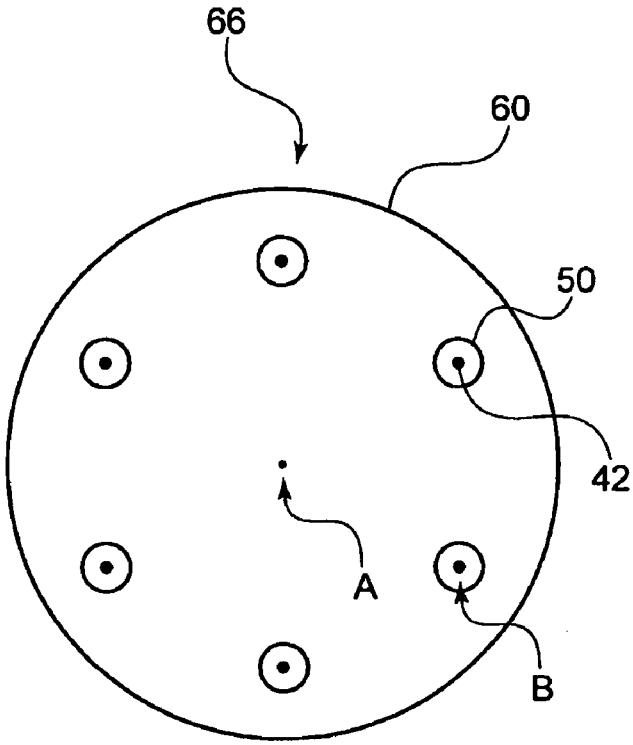
FIG. 7 is an end view of the carousel shown in FIG. 2 with stents loaded onto the holder arms (shown without the pair of stent retaining elements).

The system of the present invention may also include a holding structure that holds the medical devices in a position so that they can be coated by the rotary atomizer. The holding structure may be any type of structure, platform, framework, or scaffolding designed to hold a plurality of medical devices. In the exemplary embodiment illustrated in FIGS. 2, 6, and 7, the holding structure is a carousel 66 which includes a wheel 60 rotatable around longitudinal axis A and a plurality of holder arms 40 protruding from the wheel 60 in an array along the circumference of wheel 60. Each holder arm 40 is parallel to and radially spaced from the longitudinal axis A and holds at least one stent 50. To enhance coating uniformity, the holder arms 40 are preferably in an annular array of equal distance from the longitudinal axis A so that the stents 50 are symmetrically positioned relative to the longitudinal axis A. Rotation of the wheel 60 would allow the holder arms 40 to revolve or orbit around axis A. The rotation of the wheel 60 may be accomplished by any conventional mechanism under the control of an operator and/or automated controller. In the illustrated embodiment, the wheel 60 is rotated by a motor (not shown) connected to a rotary drive shaft 62 attached to the wheel by a flange 64. Although in this embodiment the wheel 60 rotates around the longitudinal axis A, it is not necessary that the wheel rotate in this manner or rotate at all.

The wheel 60 is dimensioned so that the rotary head 20 can be positioned inside the array of stents 50 loaded on the holder arms 40. When the system uses an electrostatic rotary atomizer, electrostatic deposition onto the stent is optimal when the terminal velocity of the spray droplets is reduced to a certain range. In many cases, a terminal velocity of less than 1 m/sec would optimize spray deposition. Therefore, in one embodiment of a system using an electrostatic rotary atomizer, the wheel 60 is dimensioned so that the distance from the edge of the rotary head to the stent is sufficient that air drag reduces the velocity of the coating droplets to less than 1 m/sec by the time they reach the stent 50. For example, the carousel 66 may be dimensioned so that the stents 50 are held about 10 cm away from the edge of the rotary head. One of skill in the art will understand that the required separation distance from the discharge edge of the rotary head to the stent will vary with the rotational speed of the rotary head, viscosity of the coating fluid, shape and dimensions of the medical devices, and quantity of electrical charge on the coating droplets. One of skill in the art would be able to determine the appropriate distance on the basis of these factors. Furthermore, in an alternate embodiment, the holding structure can be adapted to allow the operator to adjust the distance from the edge of the rotary head to the holder arms.

In another embodiment, the carousel 66 may reciprocate by translational motion (in the direction of arrow A, shown in FIG. 6) to and away from the rotary atomizer 10. Alternatively, the rotary atomizer 10 may reciprocate to and away from the carousel 66 in the same direction. The reciprocation of the carousel 66 or the rotary atomizer 10 can be achieved by any conventional mechanism under the control of the operator and/or automated controller. Such reciprocating motion can allow the spray plume to traverse the length of the stent 50 or position portions of the stent 50 within various points in the spray plume.

Figure 8:
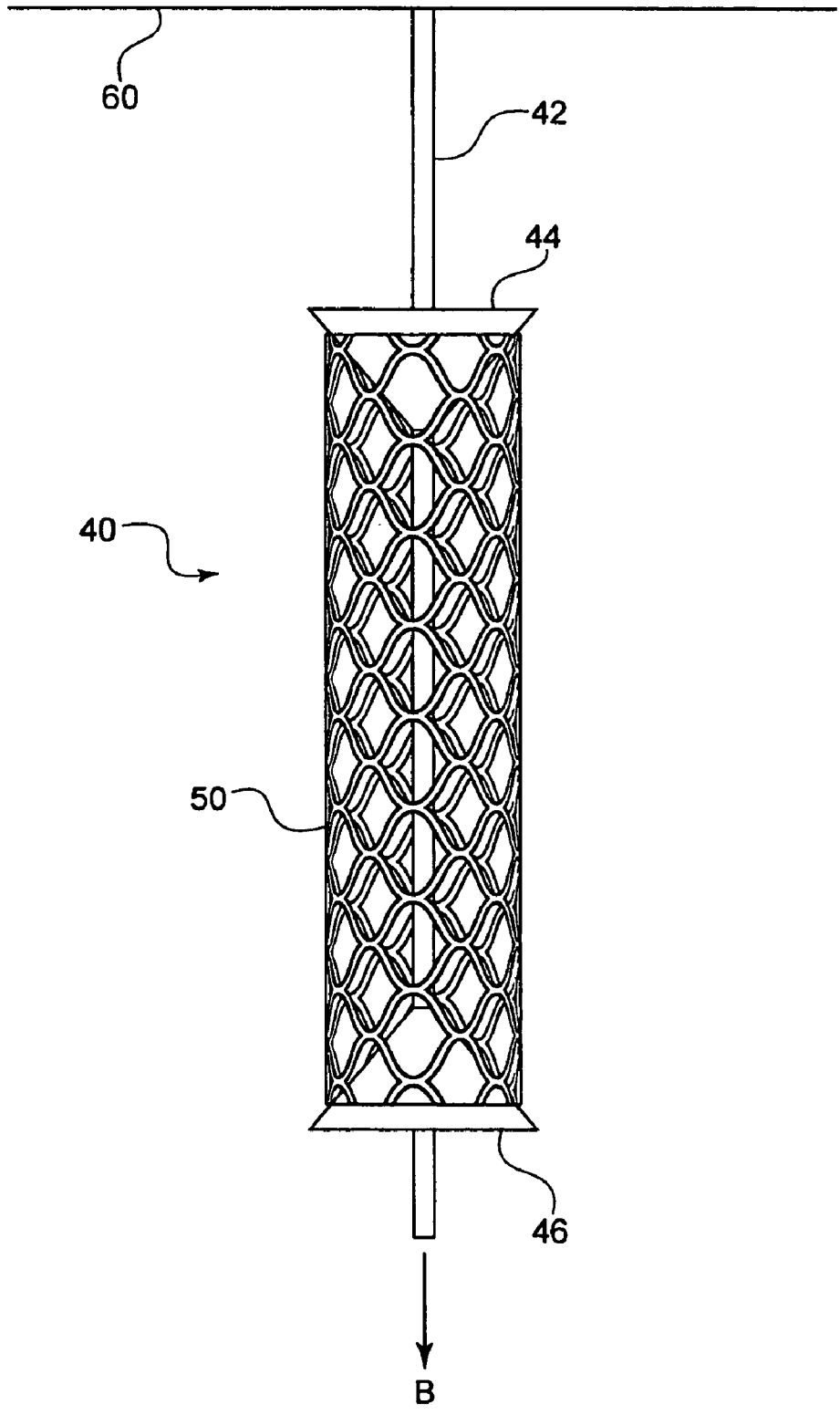
FIG. 8 is an enlarged side view of one of the holder arms shown in FIG. 6 with a stent loaded onto the holder arm.

The holder arms 40 may hold the stent 50 by any appropriate means known in the art, such as the stent holder described in U.S. patent application Ser. No. 10/198,094 by Epstein et al., whose entire disclosure is incorporated by reference herein. In the embodiment as illustrated in FIG. 8, the holder arms 40 are stent holders that comprise a center rod 42 with one end attached to the wheel 60 and a pair of cone-shaped stent retaining elements, 44 and 46. The first stent retaining element 44 is fixed on the center rod 42 while the second stent retaining element 46 is removable to allow loading of the stent 50 onto the holder arm 40. With the second stent retaining element 46 removed, the stent 50 is loaded onto the holder arm 40 by inserting it over the center rod 42 so that it rests upon the first stent retaining element 44. The second stent retaining element 46 is then placed over the free end of the stent 50 so that the stent is sandwiched between the pair of stent retaining elements with a slight compressive force applied to the stent. In this configuration, spinning of the center rod 42 will spin the stent 50 around its longitudinal axis B. One of skill in the art will appreciate that a plurality of pairs of cone-shaped stent retaining elements may be used along center rod 42 to coat multiple stents and increase production throughput. Further, combining this alternate embodiment with a rotary atomizer having multiple cups or disks may increase production throughput.

The carousel 66 may carry a mechanism for rotating each holder arm 40 about its offset axis B (aligned with the longitudinal axis of the stent) so that each stent 50 in the circumferential array of stents rotates about its longitudinal axis B while being secured in a position parallel to but radially spaced from the longitudinal axis A. The wheel 60 can include any mechanism for rotating the holder arms 40 including any mechanical, electrical or magnetic mechanisms. For example, the holder arms 40 may be rotated by a system of cables or belts and pulleys (not shown). In another example, each holder arm 40 may be connected to a small electric motor (not shown) which rotates the arm.

In the illustrated embodiment, the stents 50 are held so that the longitudinal axis B of each stent is parallel to the longitudinal axis A. However, in alternate embodiments, the stents 50 can be held at various angles relative to the longitudinal axis A. For example, the stents 50 may be held at an oblique angle with respect to longitudinal axis A. This arrangement would be useful where the rotary atomizer generates a cone-shaped spray plume and would allow improved coating deposition since the stent surfaces would face the conical spray plume more directly. In another alternate embodiment, the angle at which the holder arms 40 hold the stents 50 can be varied by the operator. One of skill in the art will appreciate that different coating finishes can be formed by varying the angle at which the stent is sprayed. One of skill in the art will also appreciate that the holder arms 40 can rotate the stents end-over-end by any conventional mechanism known in the art.

In operation, the stents 50 are loaded onto the holder arms 40 of the carousel 66. Then, the rotary atomizer 10 is activated so that it discharges a spray plume of droplets. The carousel 66 is reciprocated back and forth along longitudinal axis A so that the stents 50 are fully exposed to the spray plume while each stent 50 rotates about its own longitudinal axis B. Each holder arm 40 can carry multiple stents, and simple adjustments or modifications permit processing of stents of various diameters. The stents may be coated simultaneously or sequentially by the system. If each holder arm holds a single stent, then all the stents may be coated simultaneously. If each holder arm holds multiple stents (in a chain, for example), then the stents may be coated sequentially. The system of the present invention may be oriented in any direction, including horizontal or vertical. In a rotary atomizer, the spray droplet size varies inversely with the rotation speed of the rotary head. Therefore, the operator can vary the speed of the rotary head to produce spray droplets of the desired size, resulting in the desired coating texture.

In yet another embodiment of the present invention, the surface of the stent to be coated is first treated to create a porous surface layer having a network of pores. This porous layer can be a nano-porous surface layer created through electroplating, co-electroplating, electroless plating, sputtering, or other methods to create a porous layer. Thereafter, the rotary atomizer of the present invention is used to spray the coating material onto the porous layer so that the coating material is drawn into the pores. Because the coating material is drawn onto the large surface area of the porous structure, a greater amount and higher concentration of therapeutic agent can be applied to the stent than that allowed by typical polymer coatings. Further, because the therapeutic agent must travel through the network of pores before reaching the external environment, the therapeutic agent can be released in a slow and controlled manner. Additionally, this porous layer may allow the therapeutic agent to be applied to the stent without a polymer binder. The process of creating a porous layer is further described in the following pending patent applications: "Functional Coatings and Designs for Medical Implants," by Weber, Holman, Eidenschink, and Chen, application Ser. No. 10/759,605; "Medical Devices Having Nanostructured Regions for Controlled Tissue Biocompatibility and Drug Delivery," by Helmus, Xu, and Ranada, application Ser. No. 11/007,867;and "Method and Apparatus for Coating a Medical Device by Electroplating," by Helmus and Xu, application Ser. No. 11/007,297. The disclosures in these applications relating to porous layers and the processes of creating them are incorporated by reference herein.

Also, by first treating the surface of the stent to create, for example, a nano-porous treatment layer, the coating density may be varied depending on the concentration of the therapeutic agent in the coating layer. Thus, if the concentration of the therapeutic agent is relatively high, the coating can be denser. Further, the concentration of the therapeutic agent may be higher at the outer surface of the treated layer than the interior porous layers. Thus, more therapeutic agents may be released first from the outer surface once the device is deployed in a patient, which may be preferred. Thereafter, the release can be slower as the therapeutic agent is released from the interior porous layers. One of ordinary skill in the art will appreciate that the concentration of the therapeutic agent in the coating layer can be varied by increasing or decreasing the porosity of the porous layer, which permits more or less of the therapeutic agent to be plated, upon treating the surface of the stent.

While the medical device in the disclosed embodiments is a stent, it is to be understood that the present invention is not limited to the spray coating of stents. Non-limiting examples of other medical devices that can be spray coated with the system of the present invention include catheters, guide wires, balloons, filters (e.g., vena cava filters), stent grafts, vascular grafts, intraluminal paving systems, pacemakers, electrodes, leads, defibrillators, joint and bone implants, vascular access ports, intra-aortic balloon pumps, heart valves, sutures, artificial hearts, neurological stimulators, cochlear implants, retinal implants, and other devices that can be used in connection with therapeutic coatings. Such medical devices are implanted or otherwise used in body structures such as the coronary vasculature, esophagus, trachea, colon, biliary tract, urinary tract, prostate, brain, lung, liver, heart, skeletal muscle, kidney, bladder, intestines, stomach, pancreas, ovary, uterus, cartilage, eye, bone, and the like.

The therapeutic agent in a coating of a medical device of the present invention may be any pharmaceutically acceptable agent such as a non-genetic therapeutic agent, a biomolecule, a small molecule, or cells.

Exemplary non-genetic therapeutic agents include antithrombogenic agents such heparin, heparin derivatives, prostaglandin (including micellar prostaglandin E1), urokinase, and PPack (dextrophenylalanine proline arginine chloromethylketone); anti-proliferative agents such as enoxaparin, angiopeptin, sirolimus (rapamycin), tacrolimus, everolimus, zotarolimus, monoclonal antibodies capable of blocking smooth muscle cell proliferation, hirudin, and acetylsalicylic acid; anti-inflammatory agents such as dexamethasone, rosiglitazone, prednisolone, corticosterone, budesonide, estrogen, estrodiol, sulfasalazine, acetylsalicylic acid, mycophenolic acid, and mesalamine; anti-neoplastic/anti-proliferative/anti-mitotic agents such as paclitaxel, epothilone, cladribine, 5-fluorouracil, methotrexate, doxorubicin, daunorubicin, cyclosporine, cisplatin, vinblastine, vincristine, epothilones, endostatin, trapidil, halofuginone, and angiostatin; anti-cancer agents such as antisense inhibitors of c-myc oncogene; anti-microbial agents such as triclosan, cephalosporins, aminoglycosides, nitrofurantoin, silver ions, compounds, or salts; biofilm synthesis inhibitors such as non-steroidal anti-inflammatory agents and chelating agents such as ethylenediaminetetraacetic acid, O,O'-bis(2-aminoethyl) ethyleneglycol-N,N,N',N'-tetraacetic acid and mixtures thereof; antibiotics such as gentamycin, rifampin, minocyclin, and ciprofloxacin; antibodies including chimeric antibodies and antibody fragments; anesthetic agents such as lidocaine, bupivacaine, and ropivacaine; nitric oxide; nitric oxide (NO) donors such as linsidomine, molsidomine, L-arginine, NO-carbohydrate adducts, polymeric or oligomeric NO adducts; anti-coagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, warfarin sodium, Dicumarol, aspirin, prostaglandin inhibitors, platelet aggregation inhibitors such as cilostazol and tick antiplatelet factors; vascular cell growth promotors such as growth factors, transcriptional activators, and translational promotors; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vascoactive mechanisms; inhibitors of heat shock proteins such as geldanamycin; angiotensin converting enzyme (ACE) inhibitors; beta-blockers; βAR kinase (βARK) inhibitors; phospholamban inhibitors; protein-bound particle drugs such as ABRAXANE™; and any combinations and prodrugs of the above.

Exemplary biomolecules include peptides, polypeptides and proteins; oligonucleotides; nucleic acids such as double or single stranded DNA (including naked and cDNA), RNA, antisense nucleic acids such as antisense DNA and RNA, small interfering RNA (siRNA), and ribozymes; genes; carbohydrates; angiogenic factors including growth factors; cell cycle inhibitors; and anti-restenosis agents. Nucleic acids may be incorporated into delivery systems such as, for example, vectors (including viral vectors), plasmids or liposomes.

Non-limiting examples of proteins include serca-2 protein, monocyte chemoattractant proteins (MCP-1) and bone morphogenic proteins ("BMP's"), such as, for example, BMP-2, BMP-3, BMP-4, BMP-5, BMP-6 (VGR-1), BMP-7 (OP-1), BMP-8, BMP-9, BMP-10, BMP-11, BMP-12, BMP-13, BMP-14, BMP-15. Preferred BMP's are any of BMP-2, BMP-3, BMP-4, BMP-5, BMP-6, and BMP-7. These BMPs can be provided as homodimers, heterodimers, or combinations thereof, alone or together with other molecules. Alternatively, or in addition, molecules capable of inducing an upstream or downstream effect of a BMP can be provided. Such molecules include any of the "hedghog" proteins, or the DNA's encoding them. Non-limiting examples of genes include survival genes that protect against cell death, such as anti-apoptotic Bcl-2 family factors and Akt kinase; serca 2 gene; and combinations thereof. Non-limiting examples of angiogenic factors include acidic and basic fibroblast growth factors, vascular endothelial growth factor, epidermal growth factor, transforming growth factors α and β, platelet-derived endothelial growth factor, platelet-derived growth factor, tumor necrosis factor α, hepatocyte growth factor, and insulin-like growth factor. A non-limiting example of a cell cycle inhibitor is a cathespin D (CD) inhibitor. Non-limiting examples of anti-restenosis agents include p15, p16, p18, p19, p21, p27, p53, p57, Rb, nFkB and E2F decoys, thymidine kinase and combinations thereof and other agents useful for interfering with cell proliferation.

Exemplary small molecules include hormones, nucleotides, amino acids, sugars, and lipids and compounds have a molecular weight of less than 100 kD.

Exemplary cells include stem cells, progenitor cells, endothelial cells, adult cardiomyocytes, and smooth muscle cells. Cells can be of human origin (autologous or allogenic) or from an animal source (xenogenic), or genetically engineered. Non-limiting examples of cells include side population (SP) cells, lineage negative ($Lin^-$) cells including $Lin^-CD34^-$, $Lin^-CD34^+$, $Lin^-cKit^+$, mesenchymal stem cells including mesenchymal stem cells with 5-aza, cord blood cells, cardiac or other tissue derived stem cells, whole bone marrow, bone marrow mononuclear cells, endothelial progenitor cells, skeletal myoblasts or satellite cells, muscle derived cells, go cells, endothelial cells, adult cardiomyocytes, fibroblasts, smooth muscle cells, adult cardiac fibroblasts+5-aza, genetically modified cells, tissue engineered grafts, MyoD scar fibroblasts, pacing cells, embryonic stem cell clones, embryonic stem cells, fetal or neonatal cells, immunologically masked cells, and teratoma derived cells.

Any of the therapeutic agents may be combined to the extent such combination is biologically compatible.

Any of the above mentioned therapeutic agents may be incorporated into a polymeric coating on the medical device or applied onto a polymeric coating on a medical device. The polymers of the polymeric coatings may be biodegradable or non-biodegradable. Non-limiting examples of suitable non-biodegradable polymers include polystrene; polyisobutylene copolymers, styrene-isobutylene block copolymers such as styrene-isobutylene-styrene tri-block copolymers (SIBS) and other block copolymers such as styrene-ethylene/butylene-styrene (SEBS); polyvinylpyrrolidone including cross-linked polyvinylpyrrolidone; polyvinyl alcohols, copolymers of vinyl monomers such as EVA; polyvinyl ethers; polyvinyl aromatics; polyethylene oxides; polyesters including polyethylene terephthalate; polyamides; polyacrylamides; poly-ethers including polyether sulfone; polyalkylenes including polypropylene, polyethylene and high molecular weight polyethylene; polyurethanes; polycarbonates, silicones; siloxane polymers; cellulosic polymers such as cellulose acetate; polymer dispersions such as polyurethane dispersions (BAYHDROL®); squalene emulsions; and mixtures and copolymers of any of the foregoing.

Non-limiting examples of suitable biodegradable polymers include polycarboxylic acid, polyanhydrides including maleic anhydride polymers; polyorthoesters; poly-amino acids; polyethylene oxide; polyphosphazenes; polylactic acid, polyglycolic acid and copolymers and mixtures thereof such as poly(L-lactic acid) (PLLA), poly(D,L,-lactide), poly (lactic acid-co-glycolic acid), 50/50 (DL-lactide-co-glycolide); polydioxanone; polypropylene fumarate; polydepsipeptides; polycaprolactone and co-polymers and mixtures thereof such as poly(D,L-lactide-co-caprolactone) and polycaprolactone co-butylacrylate; polyhydroxybutyrate valerate and blends; polycarbonates such as tyrosine-derived polycarbonates and arylates, polyiminocarbonates, and polydimethyltrimethylcarbonates; cyanoacrylate; calcium phosphates; polyglycosaminoglycans; macromolecules such as polysaccharides (including hyaluronic acid; cellulose, and hydroxypropylmethyl cellulose; gelatin; starches; dextrans; alginates and derivatives thereof), proteins and polypeptides; and mixtures and copolymers of any of the foregoing. The biodegradable polymer may also be a surface erodable polymer such as polyhydroxybutyrate and its copolymers, polycaprolactone, polyanhydrides (both crystalline and amorphous), maleic anhydride copolymers, and zinc-calcium phosphate.

While the various elements of the disclosed invention are described and/or shown in various combinations and configurations, which are exemplary, other combinations and configurations, including more, less or only a single embodiment, are also within the spirit and scope of the present invention.

What is claimed is:

1. A method for coating implantable medical devices, comprising the steps of:

providing a rotary atomizer, wherein the rotary atomizer comprises at least one rotary head, wherein the rotary head has a longitudinal axis and is rotatable about the longitudinal axis;

providing a coating material reservoir, wherein the reservoir contains a coating material and is in fluid communication with the rotary atomizer;

positioning a plurality of implantable medical devices around the rotary head;

introducing coating material into the rotary atomizer; and rotating the rotary head about the longitudinal axis, thereby spraying the coating material onto the plurality of implantable medical devices with the rotary atomizer.

2. The method of claim 1, wherein the rotary atomizer is an electrostatic rotary atomizer.

3. The method of claim 1, further comprising the step of creating a porous layer on the surface of the medical device.

4. The method of claim 1, wherein positioning the plurality of implantable medical devices comprises:

providing a plurality of holders for holding the plurality of medical devices, wherein the holders are positioned around the longitudinal axis of the rotary head; and loading the plurality of medical devices onto the plurality of holders.

5. The method of claim 4, wherein each of the holders is a stent holder, and wherein each stent holder holds at least one stent.

6. The method of claim 4, wherein the holders are part of a unitary holding structure, and further comprising the step of rotating the holding structure about the longitudinal axis of the rotary head.

7. The method of claim 4, wherein the holders are part of a unitary holding structure, and further comprising the step of moving the holding structure in an axial direction parallel to the longitudinal axis of the rotary head, or moving the rotary head along the longitudinal axis of the rotary head, or both.

8. The method of claim 1, further comprising moving the plurality of medical devices in an axial direction parallel to the longitudinal axis of the rotary head, or moving the rotary head along the longitudinal axis of the rotary head, or both while the rotary atomizer sprays the coating material onto the medical devices.

9. The method of claim 1, wherein each medical device has a longitudinal axis, and further comprising rotating each medical device about its longitudinal axis while the rotary atomizer sprays the coating material onto the medical devices.

10. The method of claim 1, wherein each medical device is a stent having a longitudinal axis, and further comprising:

rotating each stent about its longitudinal axis while the rotary atomizer sprays the coating material onto the stents; and moving the plurality of stents in an axial direction parallel to the longitudinal axis of the rotary head, or moving the rotary head along the longitudinal axis of the rotary head, or both while the rotary atomizer sprays the coating material onto the stents.

11. The method of claim 1, wherein the rotary head comprises a plurality of cups or disks, and further comprising providing a different coating material to each cup or disk of said plurality of cups or disks.

* * * * *